US005334400A

United States Patent [19]

Purdham

[11] Patent Number: 5,334,400

[45] Date of Patent: Aug. 2, 1994

[54] BEVERAGE PACKAGE

[75] Inventor: Robert Purdham, Ickenham, Great Britain

[73] Assignee: Guinness Brewing Worldwide Limited, London, United Kingdom

[21] Appl. No.: 893,247

[22] Filed: Jun. 3, 1992

[30] Foreign Application Priority Data

Jun. 12, 1991 [GB] United Kingdom ..... 9112649.0

[51] Int. Cl.[5] ..... B65B 31/00; B65D 17/00; B65D 25/00

[52] U.S. Cl. ..... 426/112; 206/213.1; 206/217; 206/219; 426/115; 426/124; 426/132

[58] Field of Search ..... 426/112, 115, 124, 132; 206/213.1, 217, 219

[56] References Cited

U.S. PATENT DOCUMENTS 2,073,273 3/1937 Wetstein ..... 426/115 X
4,832,968 5/1989 Forage et al. ..... 426/112

FOREIGN PATENT DOCUMENTS 2183592 6/1987 United Kingdom .
2218080 11/1989 United Kingdom .

*Primary Examiner*—Leo B. Tentoni

[57] ABSTRACT

A sealed beverage package has a bottle 1, a neck 4 of which provides a narrow mouth 5. A hollow insert 7 is submerged in beverage 13 in the bottle. A headspace 14 in the bottle is at a pressure greater than atmospheric and when the package is opened to de-pressurise the headspace 14, gas and/or liquid under pressure in the insert 7 is ejected through an aperture 8 into the beverage to cause a head of froth to develop on the beverage 13. The insert 7 is retained in position by an open framework 9 of struts 10 which extend between the insert and a retaining ring 11 that frictionally engages in a bore 6 adjacent to the mouth 5 of the bottle. The insert 7 can be attached to the framework 9 or formed integral therewith.

9 Claims, 3 Drawing Sheets

BEVERAGE PACKAGE

TECHNICAL FIELD & BACKGROUND ART

The present invention relates to a beverage package and a method of forming such a package. More particularly it concerns a sealed package of the kind containing beverage having gas in solution and within which beverage is located a hollow insert containing gas under pressure which, upon opening of the package, causes a gas and/or liquid to be ejected from the insert by way of a restricted orifice to cause, or assist in, the formation of a head of froth on the beverage by the evolution of gas dissolved therein. The ejection of the gas and/or liquid from the hollow insert results from the opening of the package when a headspace of the beverage which, in the sealed package, is at a pressure greater than atmospheric rapidly reduces to atmospheric pressure so that a pressure differential is created which permits the gas and/or liquid under pressure greater than atmospheric in the insert to be ejected into the beverage in the container. An example of a beverage package of the kind discussed above is discussed in our Patent Specification G.B.-A-2,183,592.

Beverage packages made in accordance with the preferred embodiment of our aforementioned British Patent Specification have met with considerable commercial success where the hollow insert is located at or towards the bottom of a container and retained as a press or interference fit with the side wall of the container. This is to ensure that when the package is opened in the generally upright condition, the insert (or at least the restricted orifice thereof) is submerged within the beverage to be effective when the gas and/or liquid is ejected for forming the head on the beverage. Competitors have attempted to emulate the success of the beverage package disclosed in our aforementioned British Patent Specification where the hollow insert is frictionally retained at the bottom of the container. However, disadvantages have been found by such retention where an open top of the container through which the insert is passed is narrow compared with the part of the container adjacent its base at which the insert frictionally engages with the side wall. Consequently expensive insert handling equipment has been developed by which the insert can be passed through the narrow opening of the container in a canted position and subsequently reoriented within the container so that it can be friction fitted within the relatively broader side wall towards the bottom of the container—an example of such equipment is disclosed in G.B.-A-2,218,080. It is an object of the present invention to provide a beverage package of the kind discussed above and by which it may be ensured that the insert can be located through a relatively narrow open top of the container and secured for its restricted aperture to be submerged in the beverage when the container is in an upstanding condition in a manner which is relatively simple, efficient, and alleviates the necessity to change the orientation of the insert following its introduction into the container.

STATEMENT OF INVENTION ADVANTAGES

According to the present invention there is provided a sealed beverage package comprising a container having a base on which the package normally stands, a side wall extending upwardly from the base to an openable top and which side wall is necked as it approaches said openable top so that a top part of the container is relatively narrower than the region of the container adjacent its base; the container containing beverage having gas in solution which beverage forms a headspace that is at a pressure greater than atmospheric; a hollow insert located within the container and containing gas at a pressure greater than atmospheric, said insert having a restricted orifice and being retained so that when the container is in an upstanding condition said restricted orifice is submerged in the beverage whereby when the top of the container is opened for the headspace to communicate with atmospheric pressure, a pressure differential is developed which causes at least one of gas or liquid in the insert to be ejected, by way of the restricted orifice, into the beverage in the container for the development of a head of froth on the beverage by the evolution of gas in solution from the beverage, and wherein the insert is retained at its location in the container by an extension part of the insert which extends upwardly therefrom and frictionally engages with the narrowed top part of the container adjacent to its openable top.

Further according to the present invention there is provided a method of forming a beverage package as specified in the immediately preceding paragraph and which comprises inserting the insert and its extension part into the container through an open top thereof; pressing the extension part to frictionally engage with the necked side wall of the container adjacent to the open top to retain the insert within the container; closing and sealing the open top to provide a headspace in the container formed by the beverage having gas in solution and which headspace is at a pressure greater than atmospheric.

The present invention was primarily developed for beverage packages in which the container is in the form of a glass or plastics bottle the side wall of which converges to a neck that forms a relatively narrow top opening which, typically, will be closed and sealed with a screw cap or crown cap. With such narrow necked openings, the insert, which will usually be in the form of a hollow plastics moulded pod, will be dimensioned to pass directly through the narrow opening for insertion into the container and will be carried at the lower end of the extension part while the upper end of that part is profiled and dimensioned to be press fitted to frictionally engage within the narrow top neck of the container. By this proposal it will be apparent that the insert together with its extension part can be inserted in a relatively simple manner and as a unified structure directly into the container (usually co-axially with a generally cylindrically shaped bottle) and push fitted for the upper end of the extension part to frictionally engage with the container neck. Such frictional engagement will secure and locate the insert at a predetermined position within the container so that its restricted orifice will be submerged in the beverage of the container for its intended purpose. It is usual for necked bottles to have their necks converging upwardly to a cylindrical bore which opens in the top of the bottle and preferably the upper end of the extension part on the insert is arranged to be a tight friction fit in this cylindrical bore.

In a beverage filling line it will be usual for the hollow insert and its extension part to be located within an empty necked container following which the container will pass to a filling station where it is charged with a required volume of beverage containing gas in solution.

Thereafter the open top of the container is closed and sealed while ensuring that the headspace is pressurised. Pressurisation of the headspace may be achieved in conventional manner by dosing with liquid nitrogen so that the evolution of nitrogen gas purges the headspace of air prior to the container being sealed and following sealing the nitrogen gas develops a required pressure in the container. The insert and its extension part may be inserted and fitted to the container after the container has been charged with its beverage. More likely however the container will be charged with beverage following the insertion and fitting of the insert and its extension part; with this in mind the extension part should not obstruct, to a material extent, the flow of beverage into the container. Similarly the extension part should not materially obstruct the flow of beverage from the container when the package is opened and the beverage dispensed for consumption. Preferably therefore the extension part comprises one or more relatively narrow struts which present an open framework through which the beverage can flow into and out of the container. The upper end of the extension part from which the strut or struts extend can be in the form of a continuous or axially split (C-shaped) ring through the bore of which the beverage can flow and which ring is sufficiently resilient to frictionally engage as a secure fit in the narrow neck of the container. In a preferred arrangement the aforementioned ring is in the form of a generally cylindrical tube which is press fitted within the previously mentioned cylindrical bore at the open end of the container neck.

The extension part may be a plastics moulding to which the insert is fitted, conveniently in snap engaging relationship. Preferably however the extension part is integral with the insert, particularly where the latter is a plastics moulding.

DRAWINGS

Embodiments of a beverage package constructed in accordance with the present invention will now be described, by way of example only, with reference to the accompanying illustrative drawings in which.

DETAILED DESCRIPTION OF DRAWINGS

Figure 1:
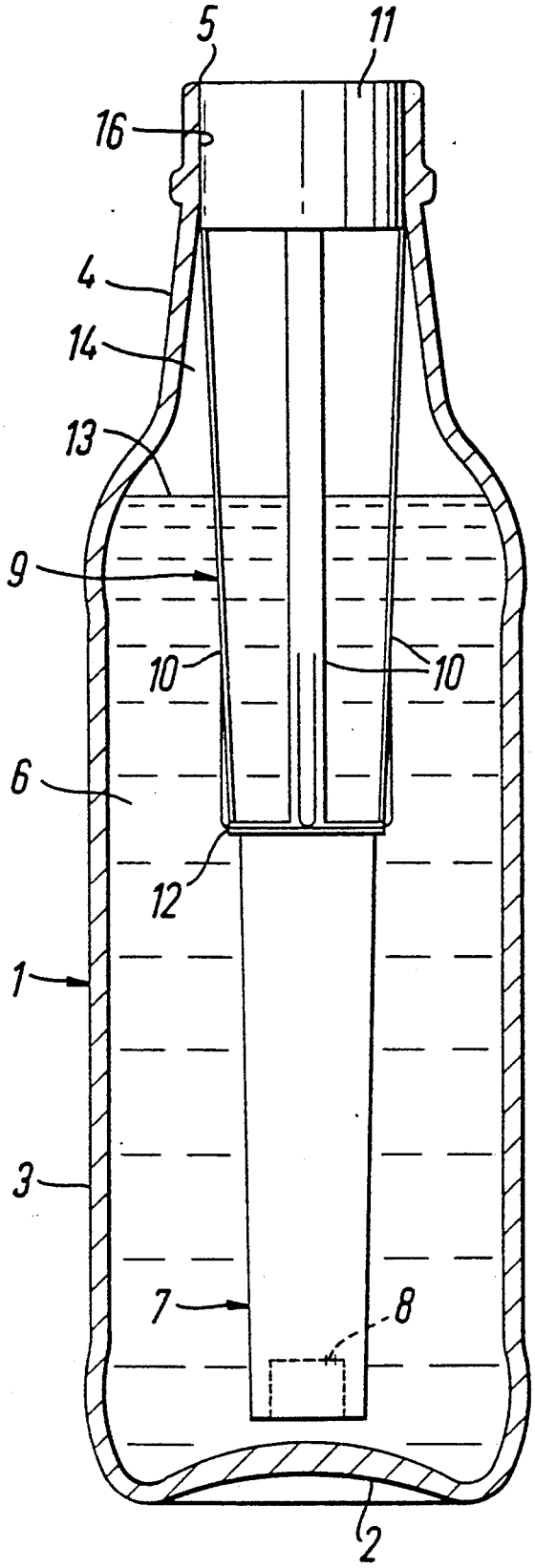
FIG. 1 is a section through a bottle container of a first embodiment of the beverage package in which the insert is located and retained by an open framework extension part which is friction fitted in a cylindrical mouth of the container.

The package is to be formed with a container 1 which consists of a conventionally shaped glass or plastics bottle having a base 2 with an upwardly extending cylindrical side wall 3 that converges to a neck 4 which defines an open top 5 for a chamber 6 within the bottle. The part length of the neck 4 within the bottle which is adjacent to the open top 5 presents a cylindrical bore 16.

Located within the chamber 6 is a hollow plastics insert or pod 7 which contains, or will contain, gas under pressure and has a restricted aperture 8 through which gas and/or liquid/beverage in the pod 7 is ejected for the purpose of developing a head of froth on beverage contained in the chamber 6.

Figure 2:
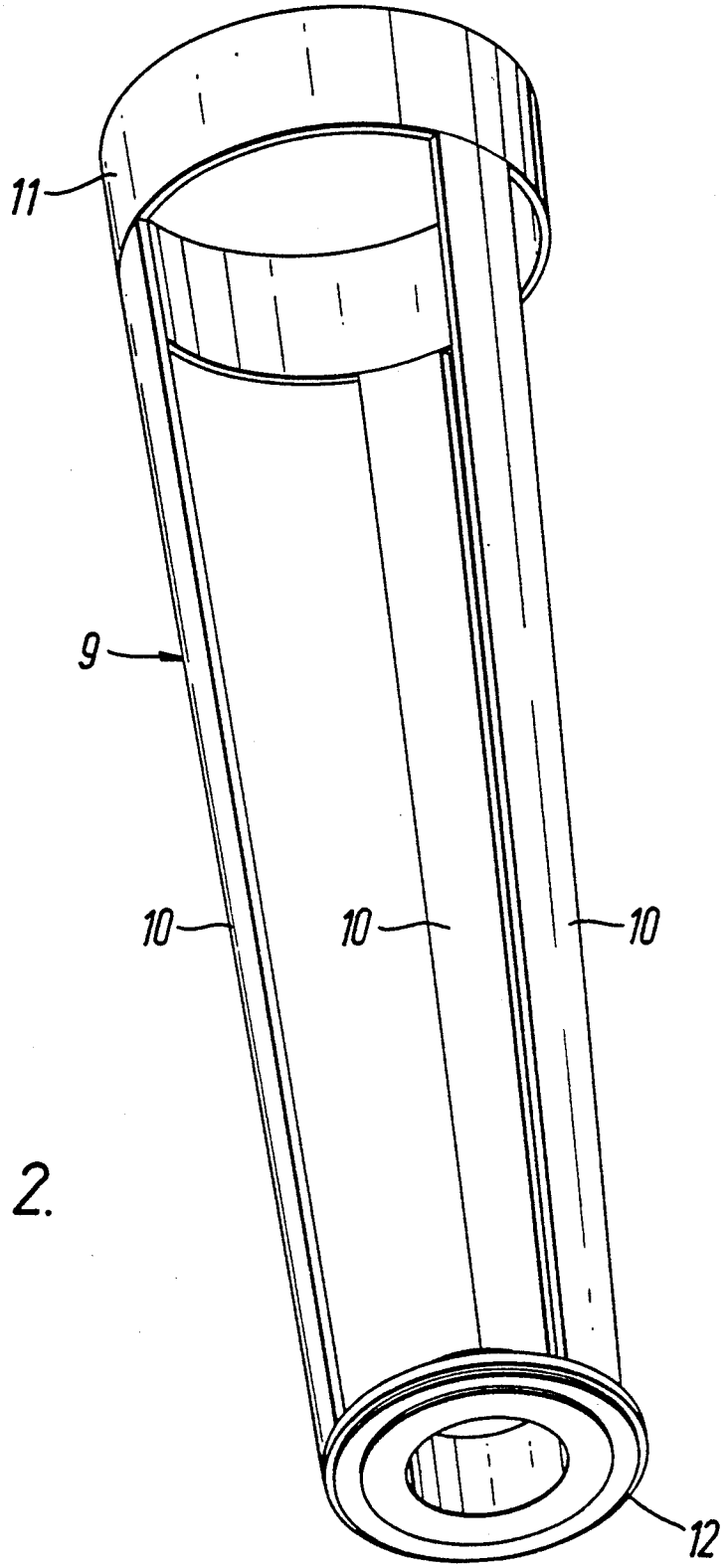
FIG. 2 is a perspective view of the extension part which is fitted in the container of FIG. 1.

The pod 7 is carried by an extension part 9. In the arrangement of FIG. 1 the extension part 9 has a generally open framework structure presented by three coextensive struts 10 which extend between and are circumferentially spaced relative to an upper retaining ring 11 and a lower pod connection ring 12 (see FIG. 2). The extension part 9 is conveniently formed as a plastics moulding and appropriate profiles are presented on the pod 7 and the ring 12 so that the pod can be snap fitted or otherwise engaged as a secure fit on the ring 12 as shown in FIG. 1. With the pod 7 fitted to the extension part 9 the resulting assembly presents a narrow elongated structure which is appropriately dimensioned to pass part way through the bore 16 of the neck 4 so that the pod 7 is received within the chamber 6, usually for the restricted aperture 8 to be located towards the base 2 of the bottle. The retaining ring 11 has a tubular cylindrical profile and is dimensioned to be received as a tight press fit within the bore 16 (and preferably flush or slightly below the top rim of the bottle neck 4) so that the extension part together with the pod 7 which it carries are firmly retained in the chamber 6 by the aforementioned friction fit to locate the restricted aperture 8 at its intended position. If required the retaining ring 11 may be split axially to be of generally C-shape or otherwise split or profiled so that the ring is closed or compresses radially during fitting into the bottle neck and the resilience of its material biases the ring into frictional engagement with the bore 16.

Following fitting of the pod 7 and its extension part 9 in the bottle 1, the chamber 6 is charged with the required beverage 13 containing gas such as carbon dioxide and/or nitrogen in solution to form a headspace 14. The beverage may be alcoholic, such as fermented stout, ale, lager or other beer, or non-alcoholic such as so-called soft drinks. The headspace 14 is pressurised, conveniently by liquid nitrogen dosing as previously discussed, and the chamber 6 sealed, typically by fitting a stopper, crown or screw cap (not shown) to the open top 5.

The pod 7 contains gas under pressure which is maintained by the pressurisation of the headspace 14. Upon opening of the container 1, the headspace 14 reduces to atmospheric pressure and, in known manner, the resulting pressure differential causes pressurised gas and/or liquid in the pod 7 to be ejected therefrom through the restricted aperture 8 for the development of a head of froth on the beverage 13, for example in the manner discussed in our Patent Specification G.B.-A-2,183,592.

The open framework structure of the extension part 9 presented by the retaining ring 11 and spaced struts 10 ensures that the flow of beverage into the container during filling will not be impeded to a material extent by the extension part nor will the flow of beverage 13 out of the container when dispensed for consumption.

Figure 3:
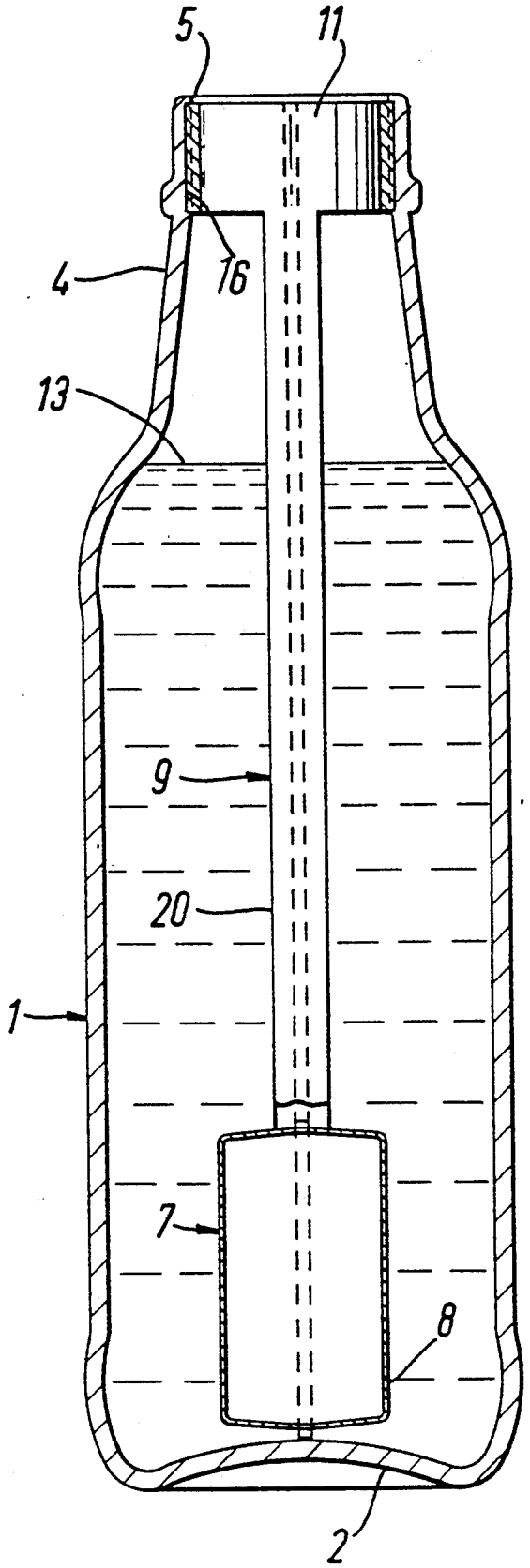
FIG. 3 is a section through a bottle container for a second embodiment of the beverage package in which the insert is located and retained by a single strut extension part which is friction fitted in a cylindrical mouth of the container.

In the embodiment shown in FIG. 3, the extension part 9 comprises a single narrow strut 20 which extends between the pod 7 and the retaining ring 11. The strut 20 conveniently communicates between one side of the pod 7 and one side of the ring 11.

If required the extension part 9 in each of the aforegoing embodiments can be formed integrally with the pod 7.

I claim:

1. A beverage package comprising a container having a base on which the package normally stands, a side wall extending upwardly from the base to a top, said top having means for sealing the package and being openable for dispensing beverage from the package; said side wall being necked as it approaches said openable top so that a top part of the container is relatively narrower than the region of the container adjacent its base; the container containing beverage having gas in solution which beverage forms a headspace that is at a pressure greater than atmospheric; a hollow insert located within the container and containing at least one of gas at a pressure greater than atmospheric or gas at a pressure greater than atmospheric and liquid, said insert having a restricted orifice and being retained so that when the container is in an upstanding condition said restricted orifice is submerged in the beverage whereby when the top of the container is opened for the headspace to communicate with atmospheric pressure, a pressure differential is developed which causes at least one of gas or liquid in the insert to be ejected, by way of the restricted orifice, into the beverage in the container for the development of a head of froth on the beverage by the evolution of gas in solution from the beverage, and wherein the insert is retained at its location in the container by an extension part of the insert which extends upwardly therefrom and frictionally engages with the narrowed top part of the container adjacent to its openable top.

2. A package as claimed in claim 1 in which the extension part is formed integrally with the insert.

3. A package as claimed in claim 1 in which the insert is an attachment to the extension part.

4. A package as claimed in claim 1 in which the inset is carried on a lower end of the extension part and an upper end of the extension part frictionally engages in a substantially cylindrical bore of the container adjacent to its openable top.

5. A package as claimed in claim 4 in which the upper end of the extension part comprises a retaining ring member which is received as a close friction fit within the cylindrical-bore.

6. A package as claimed in claim 5 in which the retaining ring member is split to flex and provide the friction fit with the bore.

7. A package as claimed in claim 1 in which the extension part has an open framework structure for beverage flow therethrough.

8. A package as claimed in claim 5 in which the extension part has an open framework structure for beverage flow therethrough and comprises struts which are circumferentially spaced on the retaining ring and extend between that ring and the insert.

9. A package as claimed in claim 1 in which the container comprises a necked bottle and the insert and extension part present an elongated profile to be received directly and longitudinally through the mouth of the bottle neck for the, or an upper, end of the extension part to frictionally engage in the bottle neck.

* * * * *